US009815605B2

(12) United States Patent
Bates

(10) Patent No.: US 9,815,605 B2
(45) Date of Patent: Nov. 14, 2017

(54) CONTAINER CARRIER

(75) Inventor: Stephen Bates, Reading (GB)

(73) Assignee: British Polythene Limited, London (GB)

( * ) Notice: Subject to any disclaimer, the term of this patent is extended or adjusted under 35 U.S.C. 154(b) by 800 days.

(21) Appl. No.: 13/509,862

(22) PCT Filed: Nov. 23, 2010

(86) PCT No.: PCT/GB2010/002163

§ 371 (c)(1),
(2), (4) Date: May 17, 2012

(87) PCT Pub. No.: WO2011/061518

PCT Pub. Date: May 26, 2011

(65) Prior Publication Data

US 2012/0227361 A1 Sep. 13, 2012

(30) Foreign Application Priority Data

Nov. 23, 2009 (GB) ..... 0920396.9

(51) Int. Cl.

| | |
|---|---|
| ***B65D 71/50*** | (2006.01) |
| ***B65B 17/02*** | (2006.01) |
| *B65D 71/00* | (2006.01) |

(52) U.S. Cl.

CPC ..... *B65D 71/504* (2013.01); *B65B 17/025* (2013.01); *B65D 71/00* (2013.01); *B65D 71/50* (2013.01); *B65D 71/508* (2013.01)

(58) Field of Classification Search

CPC ..... B65D 71/00; B65D 71/50; B65D 71/504; B65B 17/025; B65B 15/00; B65B 27/04

USPC ..... 206/145, 148; 53/35, 48.1

See application file for complete search history.

(56) References Cited

U.S. PATENT DOCUMENTS

| | | | | |
|---|---|---|---|---|
| 2,032,944 A | | 3/1936 | Lower | |
| 2,874,835 A | | 2/1959 | Ougljesa | |
| 2,936,070 A | * | 5/1960 | Poupitch | 206/150 |
| 2,997,169 A | | 8/1961 | Poupitch | |

(Continued)

FOREIGN PATENT DOCUMENTS

| | | |
|---|---|---|
| EP | 0196181 A2 | 10/1986 |
| EP | 0456357 A1 | 11/1991 |

(Continued)

OTHER PUBLICATIONS

Leijten, René, "International Search Report" for PCT/GB2010/002163, dated May 2, 2011, 4 pages.

(Continued)

*Primary Examiner* — Hemant M Desai
*Assistant Examiner* — Eduardo R Ferrero
(74) *Attorney, Agent, or Firm* — Winstead PC

(57) ABSTRACT

The present invention relates to a container carrier and to packaging systems for containers and using the same. This invention pertains to carrier stock for machine application to substantially identical containers such as beverage cans having annular chimes, cylindrical side walls, and frusto-conical walls between the chimes and the side walls. In particular, the present invention relates to plastic film having apertures to securely retain drinks cans, food cans, bottles and similar containers, a method of applying the film and the resultant combination.

16 Claims, 18 Drawing Sheets

(56) References Cited

U.S. PATENT DOCUMENTS 3,016,259 A * 1/1962 Lawrence ..... B65D 71/46 206/153
3,032,944 A * 5/1962 Hull et al. ..... 53/48.4
3,137,109 A * 6/1964 Rapata ..... B65D 71/50 53/398
3,156,358 A * 11/1964 Randrup ..... B65D 23/0892 206/153
3,281,180 A * 10/1966 Spery ..... B65D 71/48 206/140
3,317,234 A * 5/1967 Burford ..... B65D 71/50 206/145
3,346,106 A 10/1967 Gooding
3,355,013 A 11/1967 Ougljesa
3,387,879 A * 6/1968 Wood ..... B65D 71/46 206/158
3,426,501 A 2/1969 Earp
3,627,123 A * 12/1971 Wachter ..... 206/150
3,711,145 A * 1/1973 Rapata ..... 294/87.2
3,742,677 A 7/1973 Best
3,778,096 A * 12/1973 Smith ..... B65D 71/504 206/150
3,785,484 A * 1/1974 Cunningham ..... 206/427
3,816,968 A 6/1974 Morgan et al.
3,816,969 A 6/1974 Zimmerman et al.
3,874,502 A * 4/1975 Weaver ..... 206/150
3,924,738 A 12/1975 Poupitch
3,946,535 A * 3/1976 Bourgeois et al. ..... 53/398
3,959,949 A * 6/1976 Benno et al. ..... 53/398
3,966,044 A * 6/1976 Cunningham ..... 206/427
3,968,621 A 7/1976 Poupitch
3,985,228 A * 10/1976 Klygis ..... B65D 71/46 206/158
4,018,027 A 4/1977 Curry et al.
4,018,331 A * 4/1977 Klygis ..... 206/199
4,033,457 A * 7/1977 Weaver ..... 206/390
4,139,094 A * 2/1979 Berry ..... B65D 71/50 206/148
4,218,086 A * 8/1980 Klygis ..... B65D 71/46 206/153
4,219,117 A * 8/1980 Weaver ..... B65D 71/504 206/150
4,250,682 A * 2/1981 Braun ..... 53/48.4
4,287,699 A 9/1981 Hart
4,301,918 A * 11/1981 Olsen ..... 206/150
4,330,058 A * 5/1982 Klygis ..... 206/150
4,448,452 A 5/1984 Wood
4,487,312 A 12/1984 Heider
4,505,089 A 3/1985 Osteen
4,545,173 A 10/1985 Hartness et al.
4,546,876 A 10/1985 Rhoads
4,592,466 A * 6/1986 Walters et al. ..... 206/150
4,624,363 A * 11/1986 Edwards ..... 206/150
4,641,483 A 2/1987 Yamauchi
4,712,680 A 12/1987 Panazzolo
4,741,729 A 5/1988 Edwards
4,793,647 A * 12/1988 Marvin ..... 294/87.2
4,817,361 A * 4/1989 Cunningham ..... 53/48.4
4,872,549 A * 10/1989 Panzzolo ..... B65D 71/50 206/148
4,911,289 A * 3/1990 Bird ..... 206/150
4,915,217 A 4/1990 Karabedian et al.
5,054,257 A * 10/1991 Cunningham et al. ..... 53/48.4
5,063,111 A 11/1991 DiBello
5,088,269 A 2/1992 Thelen
5,117,609 A * 6/1992 Seymour et al. ..... 53/398
5,125,506 A * 6/1992 Galbierz ..... B65B 17/025 206/151
5,154,289 A * 10/1992 Van Erden ..... B65D 71/504 206/150
5,255,780 A * 10/1993 Olsen ..... 206/150
5,267,427 A * 12/1993 Peterson ..... B65B 15/04 53/390
5,413,395 A * 5/1995 Stewart ..... B65D 71/50 206/151
5,456,350 A * 10/1995 Olsen et al. ..... 206/150
5,485,914 A * 1/1996 Martin ..... 206/145
5,511,656 A * 4/1996 Olsen ..... B65D 71/504 206/150
5,590,776 A * 1/1997 Galbierz ..... B65D 71/48 206/153
5,593,026 A 1/1997 Broskow
5,671,588 A 9/1997 Chan et al.
5,695,232 A * 12/1997 Tipp ..... 294/87.2
5,735,562 A 4/1998 Borg
5,791,464 A * 8/1998 Galbierz ..... B65D 71/40 206/145
5,813,193 A 9/1998 Chan et al.
5,845,776 A * 12/1998 Galbierz ..... B65D 71/48 206/153
6,039,181 A * 3/2000 Whiteside ..... B65D 71/125 206/427
6,050,399 A 4/2000 Pratt
6,055,791 A 5/2000 Odum et al.
6,059,099 A * 5/2000 Galbierz ..... B65D 71/46 206/151
6,122,893 A * 9/2000 Weaver et al. ..... 53/48.4
6,168,012 B1 * 1/2001 Galbierz ..... B65D 71/46 206/151
6,170,225 B1 * 1/2001 Cervantes et al. ..... 53/48.4
6,170,652 B1 * 1/2001 Olsen ..... B65D 71/504 206/150
6,230,880 B1 * 5/2001 Marco et al. ..... 206/150
6,588,173 B1 7/2003 Moore et al.
6,658,815 B1 12/2003 Gaspar
6,715,810 B2 4/2004 Borg
6,814,905 B1 * 11/2004 Dalgewicz et al. ..... 264/37.32
6,874,620 B2 4/2005 Mattson et al.
7,108,128 B2 9/2006 Borg
7,195,809 B2 * 3/2007 Weaver ..... B65D 71/504 206/145
7,377,382 B2 5/2008 Borg et al.
2002/0011423 A1 * 1/2002 Weaver ..... 206/150
2003/0080004 A1 5/2003 Olsen et al.
2004/0046406 A1 3/2004 Borg
2004/0134799 A1 * 7/2004 Mattson et al. ..... 206/150
2004/0256250 A1 12/2004 Borg
2005/0112322 A1 * 5/2005 Weaver et al. ..... 428/131
2005/0234213 A1 * 10/2005 Salsman et al. ..... 528/272
2007/0039836 A1 2/2007 Borg et al.
2007/0296231 A1 12/2007 Borg
2008/0203204 A1 * 8/2008 Olsen ..... 242/160.1
2008/0236443 A1 * 10/2008 Salsman ..... 106/31.13
2008/0245680 A1 * 10/2008 Olsen ..... 206/150
2009/0090085 A1 * 4/2009 Marco et al. ..... 53/398
2009/0094938 A1 4/2009 Biernat et al.
2010/0140121 A1 * 6/2010 Slaters et al. ..... 206/223
2013/0263557 A1 10/2013 Bates

FOREIGN PATENT DOCUMENTS

EP 0461748 A1 12/1991
EP 0621203 A1 10/1994
EP 0890523 A1 1/1999
EP 1038791 A1 9/2000
EP 1077185 A2 2/2001
EP 1710171 A1 10/2006
EP 1758799 A1 3/2007
EP 1828007 A2 9/2007
EP 2028126 A1 2/2009
GB 914202 A 12/1962
GB 974619 A 11/1964
GB 1145672 A 3/1969
GB 1200807 A 8/1970
GB 1359125 A 7/1974
GB 1463898 A 2/1977
GB 1495156 A 12/1977
GB 1518210 A 7/1978
GB 2031833 A 4/1980
GB 2074123 A 10/1981
GB 2183590 A 6/1987

(56) References Cited

FOREIGN PATENT DOCUMENTS

| | | | |
|---|---|---|---|
| GB | 2475622 | A | 5/2011 |
| WO | WO-2006/009570 | A1 | 1/2006 |
| WO | WO-2006/061782 | A2 | 6/2006 |
| WO | WO-2008/001971 | A1 | 1/2008 |
| WO | WO-2009/023822 | A1 | 2/2009 |
| WO | WO-2009/046240 | A2 | 4/2009 |
| WO | WO-2011061518 | A1 | 5/2011 |

OTHER PUBLICATIONS

Ungureanu, M., "International Search Report" for PCT/GB2011/052306 dated Feb. 20, 2012, 3 pages.

* cited by examiner

CONTAINER CARRIER

FIELD OF THE INVENTION

The present invention relates to a plastics container carrier and to packaging systems for containers and using the same. This invention also pertains to carrier stock for machine application to substantially identical containers such as beverage cans having annular chimes, cylindrical side walls, and frusto-conical walls between the chimes and the side walls. In particular, the present invention relates to plastic film having apertures to securely retain drinks cans, food cans, bottles and similar containers, a method of applying the film and the resultant combination.

BACKGROUND TO THE INVENTION

It is common practice to package beverages such as sparkling fruit juices, cola drinks, beers and the like in cans, typically being manufactured from pressed aluminium or plated steel, the thickness being of the order of 50 μm or so. These cans are typically sold in four- or six packs. Early examples of packaging such packs utilised cardboard which enveloped the cans. In the 1950's plastic film container carriers were first promulgated. The early forms of plastics film container carrier utilised apertures which were deformed upon application of the sheet over the cans, whereby the film formed a continuous flange area about the side of the can. The films were placed about the top of the can, underneath a beaded edge formed at the junction of the lid of the can.

Such early forms of carrier film allowed the cans to be pulled through—albeit with some difficulty—but a reverse movement of the can with respect to the carrier would mean that the plastics flange would abut the bead and further movement required a considerable force to release the can.

FIG. 1 shows an example from U.S. Pat. No. 2,874,835 (ITW) which provides a carrier 30 comprising a flat sheet of plastic material which is provided with a plurality of apertures 32. The apertures are distinctly smaller (>20%) than a diameter of a can retained by the carrier. FIG. 1*a* shows how cans, in use are retained, with the circumferential inner edge of the plastics apertures engaging with a lower edge of rim 46. It can be seen that the plastics carrier material is substantially deformed by stretching—after considerable forces have been applied—such that the edge of the aperture is perpendicular to the plane of the plastics carrier period to placement of the cans, especially with reference to feature 40 in FIG. 1*b*. Indeed, we are advised that it is substantially impossible for the cans to come loose from the retainer device accidentally. We are advised that the use of polyethylene is a preferred plastics material, which is stamped in a press to form the apertures. This example taught of additional holes through which the ends of an elongate handle can subsequently be inserted. These plastics films—commonly referred to as carrier stock—are stretched beyond their elastic limit. That is to say the size of aperture will in turn stretch into shapes which are complimentary to the shapes of the container (per U.S. Pat. No. 4,250,682 (ITW)). The carrier stock is typically polyethylene and early examples were of a thickness of 500 μm or more, although it is typically 400 μm or more for rim applied carriers.

The forces necessary to enable the plastics film to engage with the sides of a can were considerable and, of course, the large forces that were utilised to pack the containers together resulted in problems in a consumer accessing an individual tin. GB1200807 (ITW) introduced slits in apertures, but forces of application were still considerable since the apertures were "significantly smaller than the diameter of a can with which the carrier film is to be assembled" and therefore were still stretched beyond the elastic limit of the material. U.S. Pat. No. 2,997,169 taught of a solution to the problem by the inclusion of tear-off tabs 72*b*; per FIGS. 2*a* & 2*b*, where pre-stressed members associated with tab portion enabled a tear in the plastics retaining film, which was considered easier than forcing the rim of the can around the already stretched plastics film.

The cans are of a greater diameter than the apertures and, accordingly, stretch the apertures and deform the material adjacent into a frusto-conical shape whereby the cans are aggressively retained against withdrawal in the direction opposite to that in which they have been inserted . . . .". U.S. Pat. No. 2,936,070 teaches of a still further patent, the teaching of which was to address that a plastic carrier that provides a gripping section not susceptible to loss of a can through twisting and bending movements. With reference to FIGS. 3*a* and 3*b*, resilient, flexible fingers 28 were forced upwardly (as the plastics film is placed upon a number of cans during packing), the fingers being determined by roots 30 defined partway into an inside edge portion of an aperture. FIGS. 3*b* and 3*c* show the teaching from this prior retainer in side views, where the rounded crenulations 28 are clearly visible. U.S. Pat. No. 2,936,070 advises, in particular, that the root diameter is less than the diameter of the cans and a considerable stretching force is, nonetheless, applied to the plastic material in the vicinity of the roots in stretching the material into the frustoconical, almost cylindrical conformation shown in FIG. 3*c*. The description further discloses that "the carrier can be assembled with cans with considerable facility, simply by stamping the carrier down over the proper number of cans. The cans simply cam into the apertures, deflecting the fingers . . . whereby the cans are gripped aggressively with the fingers abutting beneath the can beads". Indeed, the stamping forces would have been considerable.

Further developments included various modifications: one proposal for an article carrier was formed from a tube which was alternately slit from side-to-side in a manner leaving un-slit connecting portions at subsequent alternate opposite sides whereby successive sections of the tube may be folded relative to each other generally into a common plane for receiving the articles to be carried. In order to economize on material, it is generally desirable to make the wall of the tube as thin as possible consistent with the required strength and durability. Thus, in such heretofore proposed structures, immediately adjacent articles in a package are spaced from each other at the area of contact with the carrier only by a double thickness of the relatively thin material. It was found that such spacing is, for many purposes, insufficient since, in practice, the closely adjacent articles such as bottles or cans would rub against each other so that the respective surfaces may be scratched or otherwise defaced. For example, it is common practice to apply a label or other decorative design by lithography or other means to beverage cans and such labelling would be damaged if the cans were permitted to rub together unduly such as when the package was subjected to continual motion or vibration during transport. U.S. Pat. No. 3,924,738 provided a solution to this problem by forming longitudinally extending rib means whereby to provide a separation spacing between cans, as shown in FIG. 4.

U.S. Pat. No. 3,968,621 taught of manufacturing a carrier by the formation of an extruded net, which net was subsequently flattened by the use of a roller to produce an apertured film of carrier stock, as shown in FIG. 5. U.S. Pat. No. 3,317,234 teaches of a packaging system using an upper laminate and a lower laminate. As seen with reference to FIGS. 6*a* and 6*b*, the upper laminate comprising a first, continuous plastics layer and a second laminate comprising an apertured card layer is placed over an arrangement of bottles. The apertures of the card layer are arranged to fit over respective metal cap of a drinks bottle, the peripheral edges of the apertures being arranged to engage with the underside of the metal cap, whereby to retain the upper part of the bottle. The lower laminate being arranged to act in a similar fashion with a bottle having a characteristic waist, about which a card member of the second laminate could engage, in conjunction with a plastics layer, which enveloped a lower portion of the bottle. In a similar fashion, cans were retained by substantially similar first and second laminates, the card element of which engaging with a body-directed edge of the respective upper and lower rims of a double rimmed can.

In the early 1980's, there was a shift in the method of applying film stock to cans and the like. Previous forms of strip stock for circularly cylindrical containers had been provided with substantially circular apertures. In contrast teachings equivalent to or derived from U.S. Pat. No. 4,219,117 (ITW), which were designed for application by dedicated jaw and drum machinery (such as described in U.S. Pat. No. 4,250,682) utilised stock that had integrally joined band segments defining can receiving apertures in longitudinal rows and transverse ranks. The band segments included generally longitudinal outer segments with each outer segment partly bounding the can receiving apertures in an outer row. The apertures defined in such stock are generally of a triangular/D shape, primarily to assist in the mechanical placement of the stock around the rim of a can, which mechanical application necessitated the use of mechanical fingers which generally prevented the simultaneous use of such devices in any configuration other than in the provision of two-rank longitudinal rows. That is to say the cans are attached with two cans being in a side-by-side arrangement: the systems generally could not reliably operate to provide cans packed, for example in 3×3 or 3×4 or 4×4 etc arrangements.

In the carrier stock illustrated and described in the U.S. Pat. No. 4,219,117, the band segments also included inner segments partly bounding the can-receiving apertures, along with transversely extending segments joining the inner segments, for finger-hold grip elements.

Can manufacturers have in the past introduced cans having smaller chime diameters, as compared to the diameters of the side walls. Cans of this type are known as "necked-in" cans. The newest versions of these necked-in cans further and drastically reduce the ratio of the chime diameter and the side wall diameter. When stock is applied by known procedures, the band segments defining the can receiving apertures grip the frusto-conical walls of the cans tightly and engage the lower edges of the chimes.

In a necked-in can of a newer type, the frusto-conical wall between the chime and the side wall defines a conical angle greater than approximately 28° and in some instances as great as approximately 37°. When the frusto-conical wall defines such a large angle relative to the can axis, it is difficult to apply carrier stock since the band segments defining the can receiving apertures have an undesirable tendency to slide up the cans and to rest on the cans above the lower edges of the chimes. This tendency is enhanced due to the jaw application system mentioned above.

A further problem of known systems, where great forces have been used to apply the carrier stock, that they can be difficult to remove—not only by accident; in use, especially by youngsters, has caused effervescent spillage to occur since the removal by force of a drinks can from a carrier strip has resulted in an unnecessary disturbance of the effervescent liquid inside, resulting in a spray or spillage upon a subsequent opening of the can. In EP0461748(ITW) and EP0621203 (ITW)—which address the provision of tear-open tabs, which extend upwardly across the chimes of straight-walled and conical cans, respectively, whereby to simplify release. The tabs in the later patent have concave lateral portions adjacent a stem of the tab "for stress relief". Furthermore, both these documents involve the use of relatively thick (greater than 400 μm) and in placement around cans are stretched beyond their elastic limit. These types of carrier stock have not, however, been widely adopted. This utilises a thick plastics sheeting which is stretched beyond its elastic limit.

OBJECT TO THE INVENTION

The present invention seeks to overcome at least one problem associated with the prior art. The present invention seeks to provide a process for grouping containers such as cans and bottles whereby great stretching forces are not required to enable attachment of several containers in a six-pack or similar. The present invention also seeks to provide a carrier film which can locate with cylindrical containers and frusto-conical containers using the elastic properties of the carrier film.

SUMMARY OF THE INVENTION

In accordance with a first aspect of the invention, there is provided carrier stock provided with a number of apertures for holding a number of containers together, the stock comprising a thin plastics sheet material having a number of apertures arranged in at least a first direction, wherein the apertures comprise a plurality of finger elements, separated by troughs, the apertures having a centre; wherein the peak of the finger elements lie on a first circumference relative to the centre and the bottom of the troughs lie on a second circumference relative to the centre, the second circumference being equal to or greater than the circumference of the container; wherein the peaks of the fingers are operably engageable with a beading of a container as the troughs are urged downwardly and outwardly; the troughs being operable to allow the film to elastically deform upon placement and enable the film to adopt a three dimensional structure. Whilst the present invention requires at least three fingers, it has been found that a four fingered aperture benefits in terms of packaging of product by reason of the forces from the chime, through the finger, allow upward movement of film adjacent the troughs, whereby to create a wave effect. The three dimensional structure adopted by the film is analogous to a vehicular monocoque structure; the strength of the shaped stock with containers is greater than that of the otherwise flexible material.

Applicants have determined that at the point where the fingers meet with the underside of a beading of a container, such as the chime of a beverage can, the material is deflected in a downwards direction. Because the contact is discontinuous, this creates a three dimensional wave in the material which acts against the tabs or fingers and forces them to remain in contact with the containers. At the corners of the sheet (in the case of a four pack for example) opposite where the cut outs in the aperture are situated, because there are no downward forces, only lateral ones exerted by the effect of the fingers acting against the chimes, the material is forced into an apex at its furthest point from the can contributing to the wave effect. This combination of wave effect and apex further prevents the fingers from moving away from the underside of the chime and ensures the containers are held securely.

The film is conveniently manufactured from 100-300 μm thickness plastics, which plastics can be selected from the group comprising polyethylene, polyethylene derivatives and plastics materials with similar mechanical properties. The material, since it is not stretched to an extent where any occlusions or similar defects may give rise to subsequent problems, can be made from recycled plastics such as post consumer waste (PCW) plastics. In view of the stresses that are applied both in the fitting of the stock by machines and in subsequent use and transportation, previous systems always employed good quality plastics: re-cycled plastics materials (post consumer waste (PCW) material) may have inclusions within the material whereby the integrity of the stressed plastics sheet is questionable.

The apertured material conveniently has further reduced size apertures within the material between the container receiving apertures, such further apertures assisting in the wave effect to be defined and assists in the apertures be more simply fastened about a container. Apertures may also assist in the manual handling of completed container pack, by providing finger access apertures. Additionally, it should be borne in mind that having an increased number of apertures in the film will mean that the overall cost of material supply is reduced.

The apertured material can be dimensioned to fit around traditional cylindrical walled cans such as traditional baked-bean can. The apertured film can be dimensioned to fit about the necked-in cans as are typically presently produced in the beverage industry. The apertured film can be dimensioned to fit about the necks of bottles, wherein beading around the neck of a bottle can act in a similar fashion to the chime or beading of a can. The apertures can resemble a generally square-like (quadra-arcuate) aperture, with the tabs comprising slightly outwardly extending arcs. Other poly-arcuate apertures are possible, the number of tabs, however being less than ten, for containers as are commonly employed for beverages.

The carrier stock or film of the present invention can comprise integrally joined band segments defining can receiving apertures in longitudinal rows and transverse ranks. There may be a single longitudinal row. The band segments include generally longitudinal outer segments with each outer segment partly bounding the can receiving apertures in an outer row. In application, the carrier stock or film can be provided as a roll for use in a roll on method of applying the product, conveniently in a multi-lane format of typically but not exclusively 6 lanes wide. The sheet material is supplied on a roll and feeds into the application machine in a near continuous action, whereupon it is subdivided within the machine into the required pack sizes, e.g. 4 packs, 6 packs etc. The method of rolling film on to the top of the container uses the downward pressure of the roller as the containers pass beneath it to gently elastically form the material through the interaction of film and container in order to achieve the aforementioned gripping action and 3 dimensional transformation of the sheet material.

In particular, the film after application to a number of containers defines a three dimensional shape as a direct result of the various forces acting upon the material, whereby to increase the inherent strength of the resultant product. As a direct result of the increase in strength of the applied film (in three-dimensions), a reduction in the grade and thickness of the film material can be realised: costs can be reduced because less raw material is required. Further by virtue of the machinery not being required to exert tremendous forces to enable the material to engage with containers, the specification of the packaging plant can be reduced, again reducing costs. A still further advantage is that because the machinery is less massive and can be applied without large mechanical jaws/hands (as are presently used in the industry—which impede the function of adjacently located mechanical jaws/hands), several packing streams can be simply placed in side-by-side configuration—even enabling 12-aperture rows to be manufactured.

Thus the present invention takes advantage of physical properties of sheet material whereby, surprisingly, containers such as beverage cans can be retained by a sheet of a thickness much reduced to the sheet widely employed hitherto which has been placed over the rim of the container, whereby a plurality of inner edges defined along an inner circumference of the aperture abut an underside of the rim, in the free state the inside circumference being less than the circumference of the can, below the rim, the sheet material, by virtue of a discontinuous circumferential contact about said rim, whereby to conform in a three-dimensional form which offers stability and strength to a container and film combination. Specifically, the three-dimensional form provides a strength far greater than that which would have been achievable with a standard film. As a direct result of its increased strength, the material of choice can be selected for price and availability rather than quality per se.

The above and other advantages enable the objectives of the invention to be achieved.

BRIEF DESCRIPTION OF THE FIGURES

Some preferred embodiments of the invention will now be described, by way of example, with reference to the accompanying drawings, of which.

DETAILED DESCRIPTION OF THE PREFERRED EMBODIMENTS

There will now be described, by way of example only, the best mode contemplated by the inventor for carrying out the present invention. In the following description, numerous specific details are set out in order to provide a complete understanding to the present invention. It will be apparent to those skilled in the art, that the present invention may be put into practice with variations of the specific.

Figure 1A:
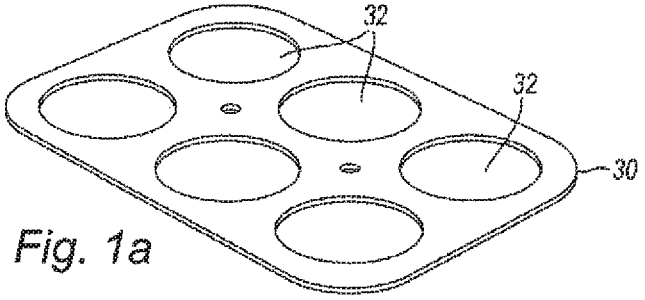
Fig. 1a PRIOR ART
FIGS. 1*a-c* show a first example of known carrier stock.
Figure 1B:
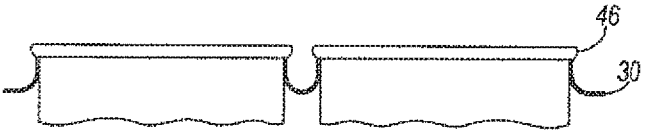
Fig. 1b PRIOR ART
Figure 1C:
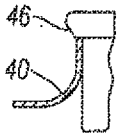
Fig. 1c PRIOR ART
Figure 2A:
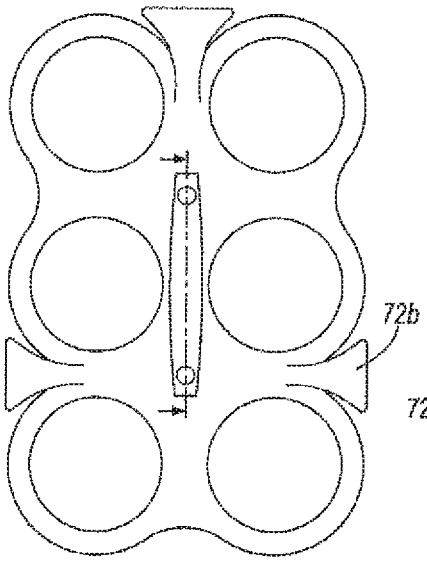
Fig. 2a PRIOR ART
FIGS. 2*a, b* show a second example of known carrier stock.
Figure 2B:
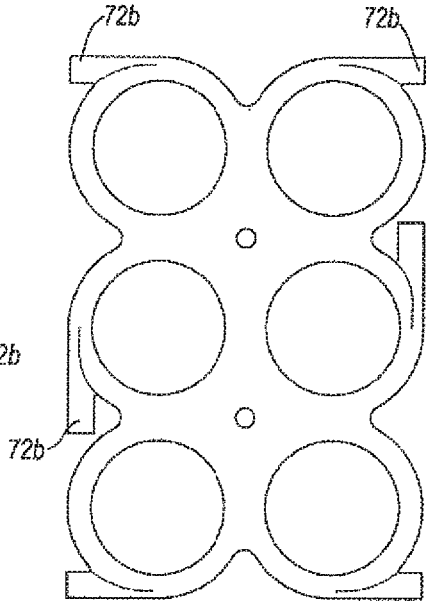
Fig. 2b PRIOR ART
Figure 3A:
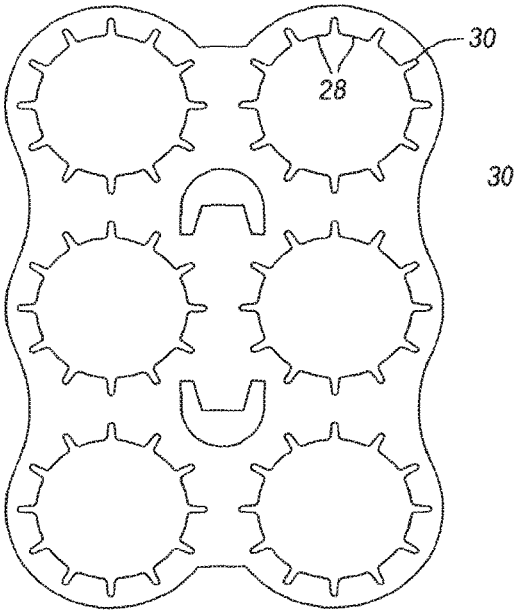
Fig.3a PRIOR ART
FIG. 3*a-c* show a third example of known carrier stock.
Figure 3B:
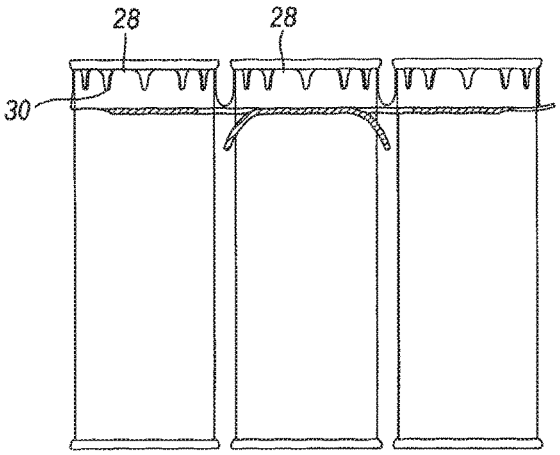
Fig.3b PRIOR ART
Figure 3C:
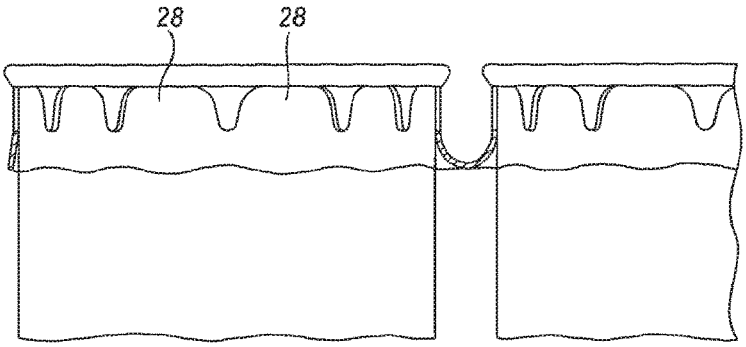
Fig.3c PRIOR ART
Figure 4:
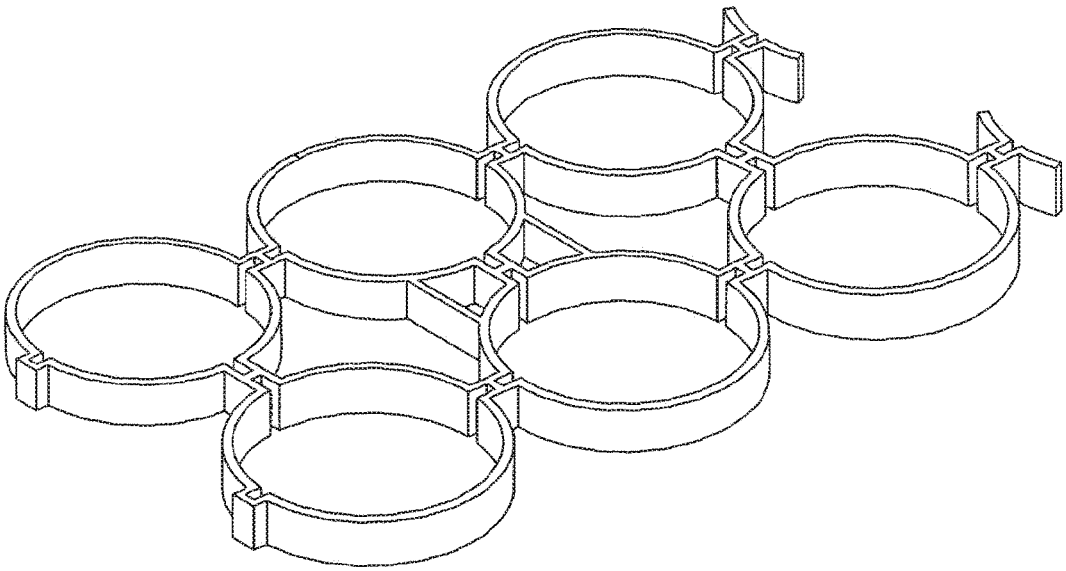
Fig.4 PRIOR ART
FIG. 4 shows a container carrier comprising strips of material.
Figure 5:
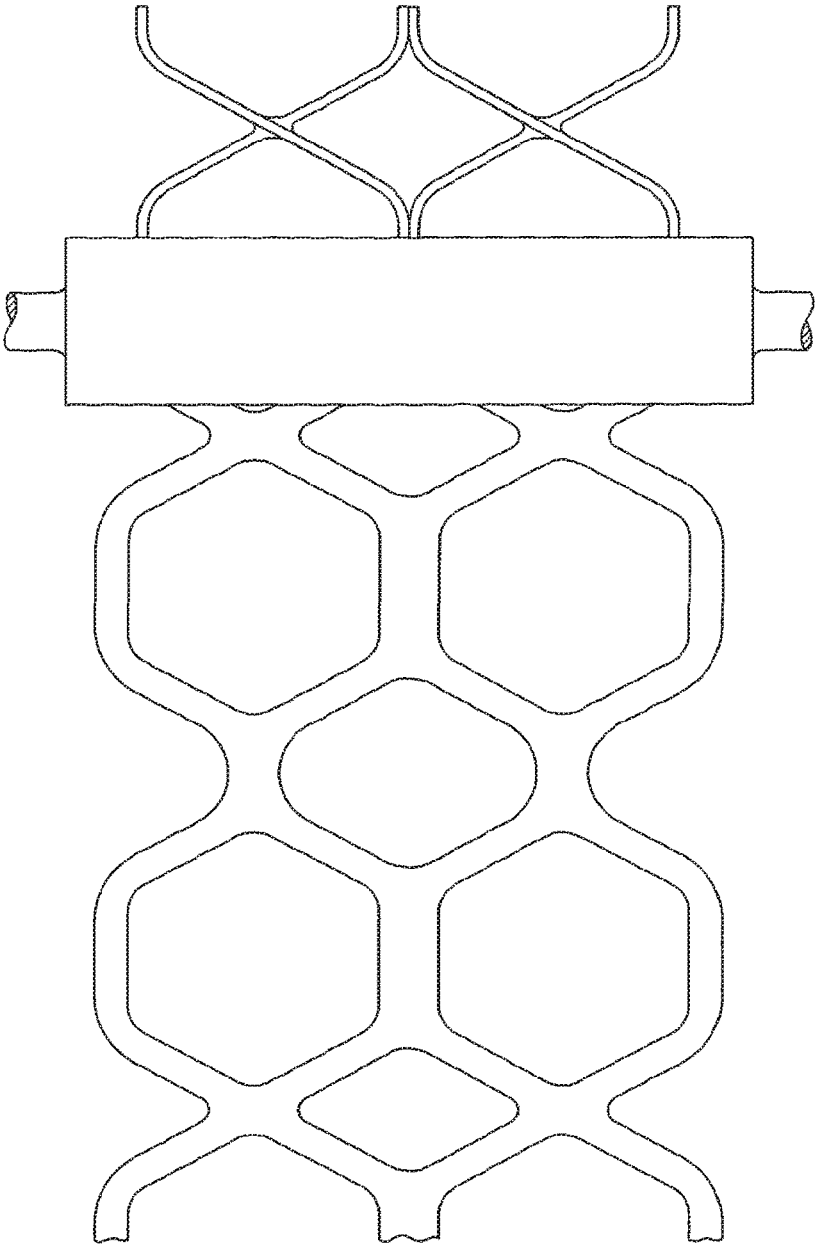
Fig.5 PRIOR ART
FIG. 5 shows another prior art container retaining means.
Figure 6A:
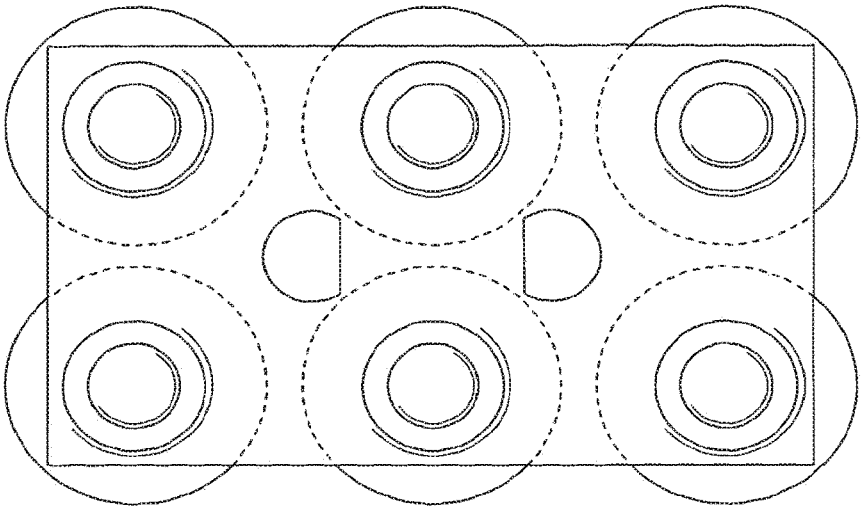
Fig.6a PRIOR ART
FIGS. 6*a, b* show card and plastics laminate container retaining means.
Figure 6B:
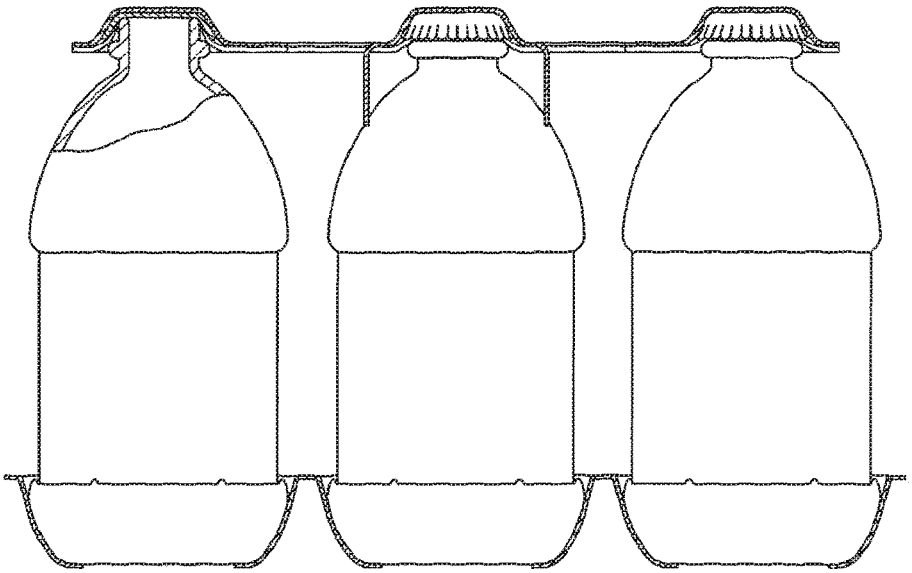
Fig.6b PRIOR ART
Figure 7A:
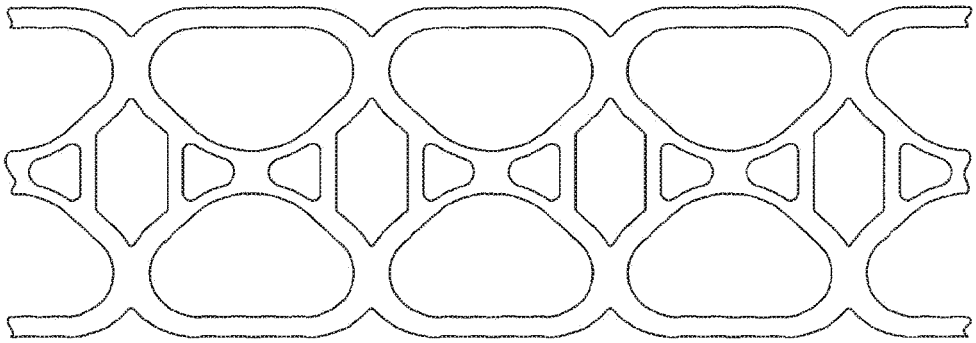
Fig.7a PRIOR ART
FIGS. 7*a-e* show examples of presently commonly used carrier stock.
Figure 7B:
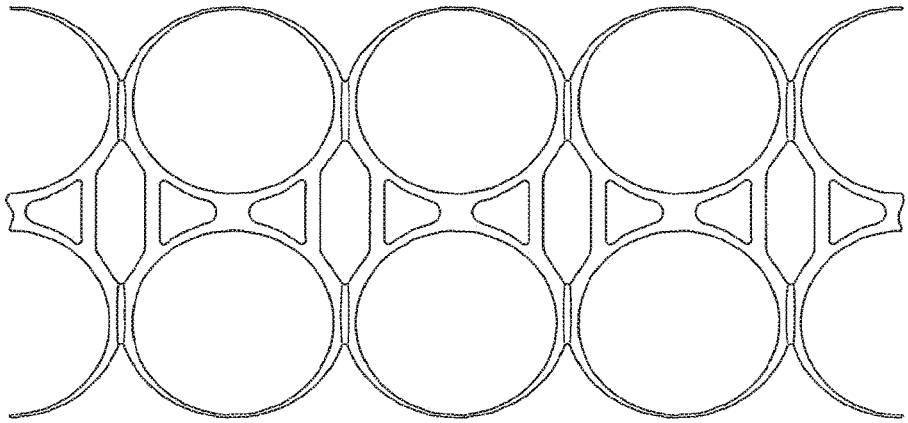
Fig.7b PRIOR ART
Figure 7C:
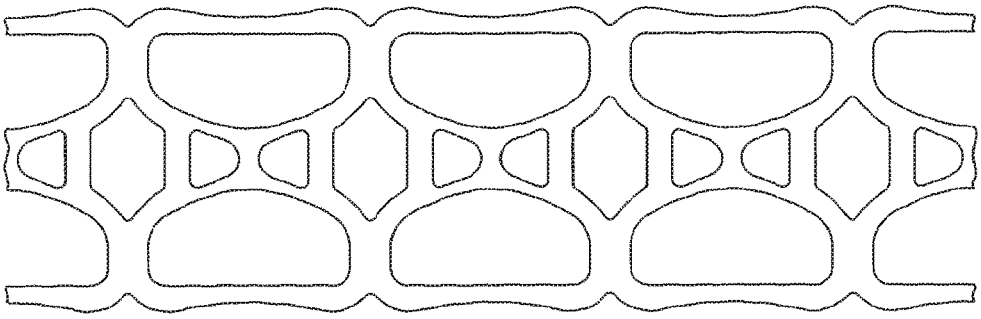
Fig.7c PRIOR ART
Figure 7D:
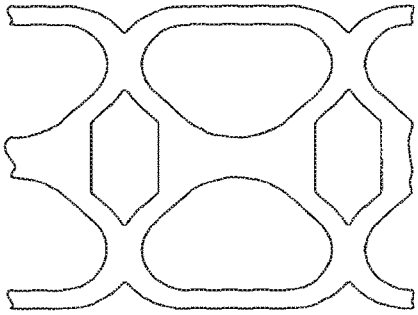
Fig.7d PRIOR ART
Figure 7E:
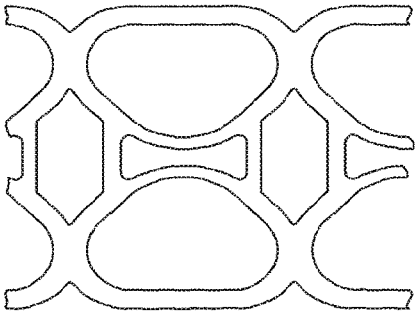
Fig.7e PRIOR ART
Figure 8A:
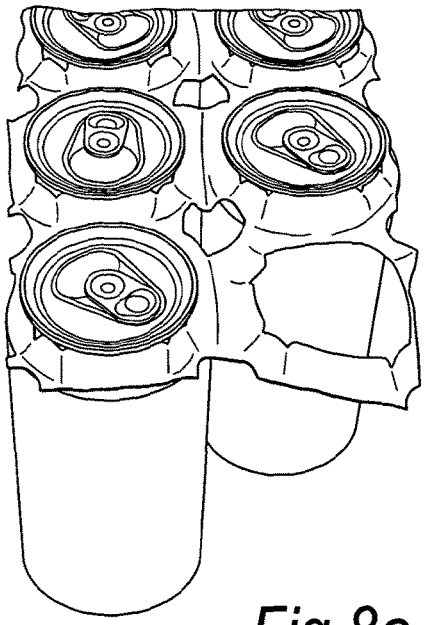
FIGS. 8*a-c* show a first embodiment of a film and the same in use.
Figure 8B:
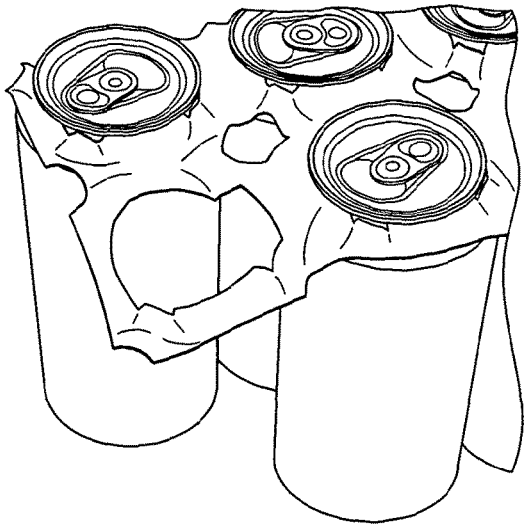
Figure 8C:
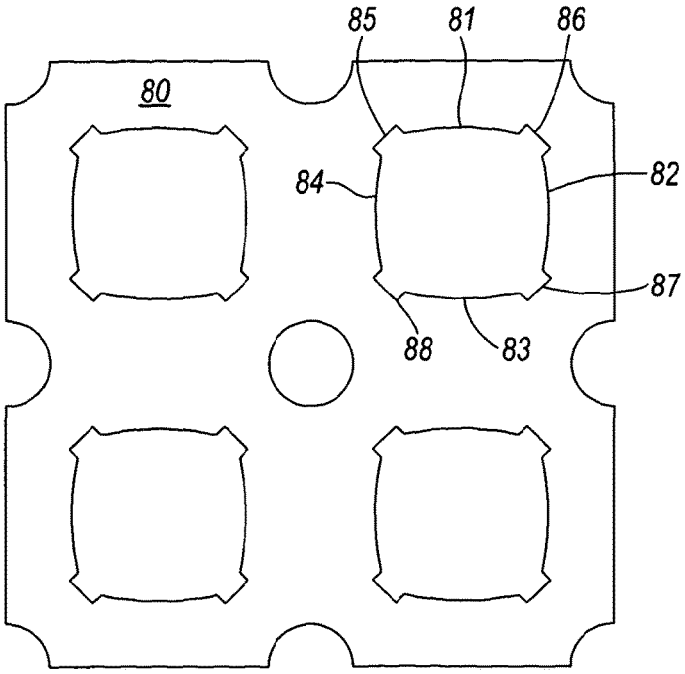

The present invention shall now be described with reference to a first embodiment as shown in FIGS. 8*a-c*. FIGS. 8*a* and 8*b* show first and second perspective views of an arrangement of five beer cans retained by plastics film stock having six container apertures. The plastics film is shown in plan view in FIG. 8*c*. Each aperture 80*a* is of a general square shape, operably arranged to accept a circularly cylindrical part of a container therethrough, with four fingers or tabs 81, 82, 83 & 84 extending from indentations or troughs having a web element connecting adjacent fingers. The troughs lie on a radius slightly greater than the radius of the container about which the film is designed to retain. The nails of the fingers, i.e. the portions that will abut the rim or chime of the can, are conveniently slightly curved inwardly. Indeed, in order to most closely fit about a container, the arc corresponds to an arc of a circle of a radius corresponding to a radius of the container that lies immediately adjacent the rim or chime of the container, the shape taking into account the fact that the film will adopt an undulating shape in view of the resilience of the plastics film being utilised. It is important to note that whilst the elastic properties of the film are utilised, the elastic limit of the material is not approached.

In use, carrier stock provided with a number of apertures for holding a number of containers together, the stock comprising a thin plastics sheet material having a number of apertures arranged in at least a first direction. The apertures comprise a plurality of finger elements, separated by troughs, the apertures having a centre. The peak of the finger elements lie on a first circumference relative to the centre whilst the bottom of the troughs (that part of the troughs most distant from the centre) lie on a second circumference relative to the centre, the second circumference being equal to or greater than the circumference of the container. In use the peaks of the fingers engage with a beading of a container whilst the troughs, as a direct result—since they are part of the same film—are urged downwardly and outwardly. In so doing the troughs urge the film to elastically form upon placement and enable the film to adopt a three dimensional structure. Whilst the number of fingers can vary from three upwards, it has been found that a four fingered aperture (or multiple finger equivalents operable to achieve the same effect) benefits in terms of packaging of product by reason of the forces from the chime, through the finger, allow upward movement of film adjacent the troughs, whereby to create a wave effect. The three dimensional structure adopted by the film is in many ways analogous to the types of structures in vehicular manufacturing i.e. the structure is a monocoque structure where the overall strength of the finished film is greater than that of the inherently flexible material.

Referring in particular to FIG. 8*c*, film 80 is provided with apertures 81, the apertures being defined by fingers 82-85. One aperture 81 will now be discussed: the distance between the centres of oppositely facing fingers is approximately 90% of the diameter of the portion of the container about which the aperture will close upon, whilst the distance between opposite troughs corresponds to 110% of said diameter. As can be seen, with further reference to FIGS. 8*a* and 8*b*, the fingers 82-85 abut the lower part of the chime or rim of the can and the film closely follows the necked-in portion of the container. Rather than utilising the elasticity of the material to enable containers to be retained, the film in accordance with the invention adopts a three dimensional geometrical form that enables the shape of the film to thereby provide a relatively rigid arrangement. In actual fact, rather than utilise high quality virgin plastics film of a preferred thickness in the range of 400-500 μm, the present invention can utilise recycled plastics film of a thickness of 350 μm or less. It is to be realised that whilst the weight of a single apertured film for a six-pack is of the order of a couple of grammes, globally, several thousands of tons of plastics are employed in the manufacture of container film. A reduction in the amount of plastics by 25% or more will provide a significant reduction in operating costs for any canning plant. Additionally, it is known in the art (for example EP1038791), that any buckling of a transverse web is to be minimised because of customer perception; a smooth transverse web is believed to be more aesthetically pleasing.

As will be appreciated, prior systems for linking containers more closely approach the elastic deformation limit of the plastics material. Indeed, in the apparatus as shown in U.S. Pat. No. 4,250,682 a machine is shown which engages a carrier strip and assembles the carrier strip with a plurality of articles moving in close relation thereto. The apparatus in Braun has a rotary drum with carrier stretching members for engaging, stretching and positioning the carrier strip over the tops of the articles moving there-under such that the carrier material is retained under the chime of the article. Similarly, in another teaching (EP0456357) it is stated that a carrier strip engaging assembly is used to elastically deform the engaged carrier strip for assembly with articles.

Since recycled materials are more likely to have inclusions and other faults, which can compromise the strength of material that is stretched towards an elastic limit, the industry has previously not been able to accept such materials, increasing the financial burden in the packaging industry. Not only does the present invention provide a solution which uses less raw material and is according more "environmentally friendly" than prior solutions, the raw material for the present invention can indeed comprise re-cycled material or at least have a significant recycled material content.

The procedure of application of the apertured film in accordance with the present invention can be conveniently formed by a number of methods. A presently preferred method will be described with reference to FIG. 8*c*, which, for convenience shall be assumed to be receiving a can, not shown, from the right; the inside edge of finger 84 of the aperture is urged toward the under-chime (upper rim) of a can; the adjacent side fingers 81, 83 of the aperture are then eased over the corresponding rim parts of the can until the inside edge of the aperture opposite the first engaged side of the aperture is adjacent the rim, whereupon continuing pressure enables the inside edge of the last aperture finger 82 to engage with an underside of the rim, thereby enabling the apertured film to be simply, safely and securely engaged therewith. It will be appreciated that since significant forces would not be required to enable the apertures to be placed over containers, then the machinery need not be so massive and that three or more containers may be easily be retained by a film in accordance with the invention; previous systems cannot reliably unitize more than two containers in a process such as a fast moving production line.

Whilst the first example is a square aperture, it will be appreciated that a generally three fingered aperture may be provided, comprising a generally equilateral triangular configuration, and would provide a minimally fingered design with a security of retention. It will be appreciated that many polygonal form can be configured which operate in accordance with the inventions, although, a regular four-sided aperture is likely to be more readily generally accepted. Containers of other cylindrical shapes can be retained; it may be appropriate to have five, six or more fingers or tabs per aperture. Ten have been found to be a convenient limit for large domestic containers.

Figure 9:
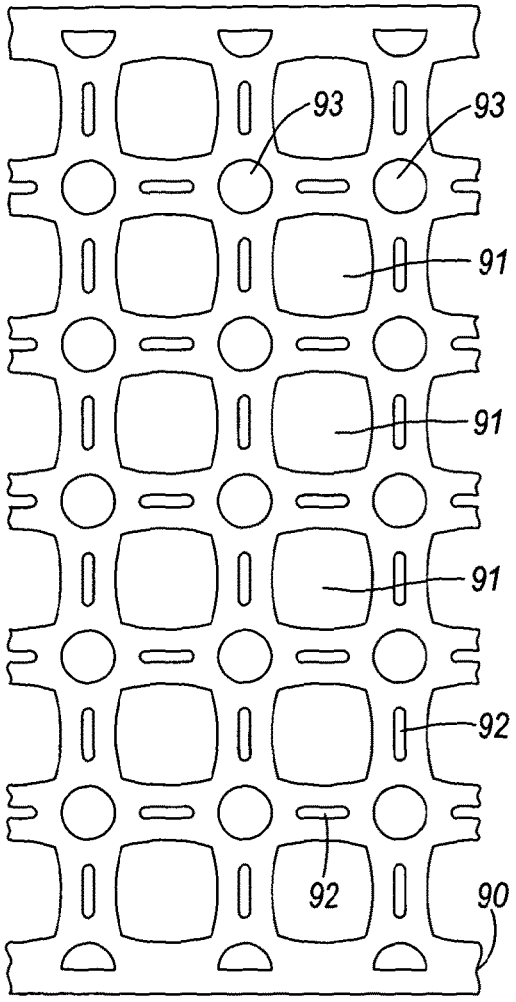
FIG. 9 shows a second embodiment.

Referring now to FIG. 9, a portion of film 90, with six apertures abreast, is shown, the apertures 91 being of a second regular quadrilateral shape. Further apertures or slits 92, together with circular apertures 93 are sized and positioned to assist in the maintenance of the monocoque film shape, once containers have been retained by the film. The circular opening 93 may be formed of difference shapes or may be replaced by a number of smaller aperture, conveniently closely spaced together. In this film the shape and position of the apertures are such that the troughs between the fingers correspond with the corners of the curved sides, the distance between opposite troughs being approximately 110% the diameter of the container at the rim.

Figure 10:
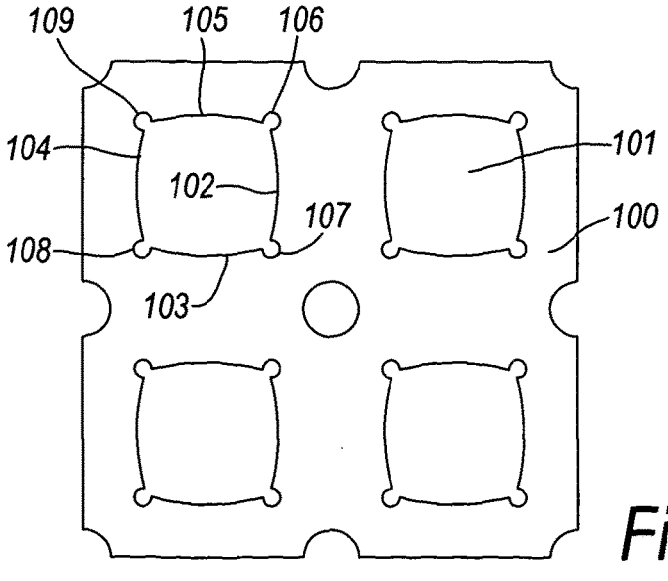
FIG. 10 shows a third embodiment.
Figure 11:
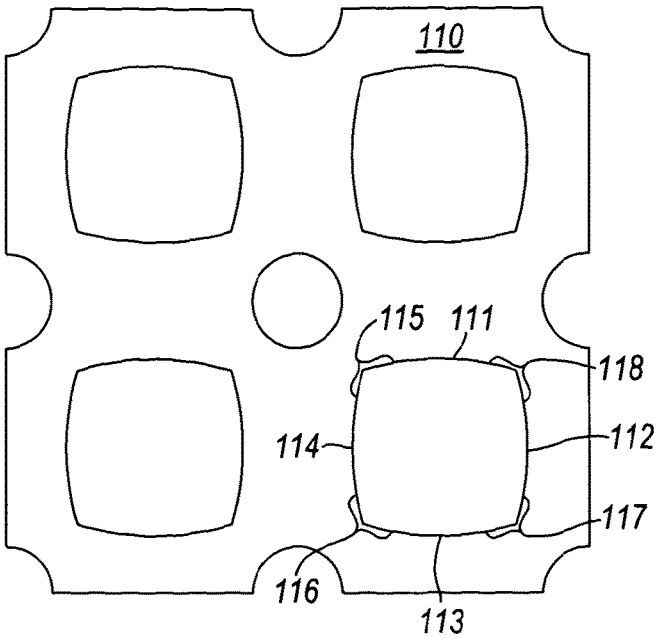
FIG. 11 shows a still further embodiment of the invention.
Figure 11A:
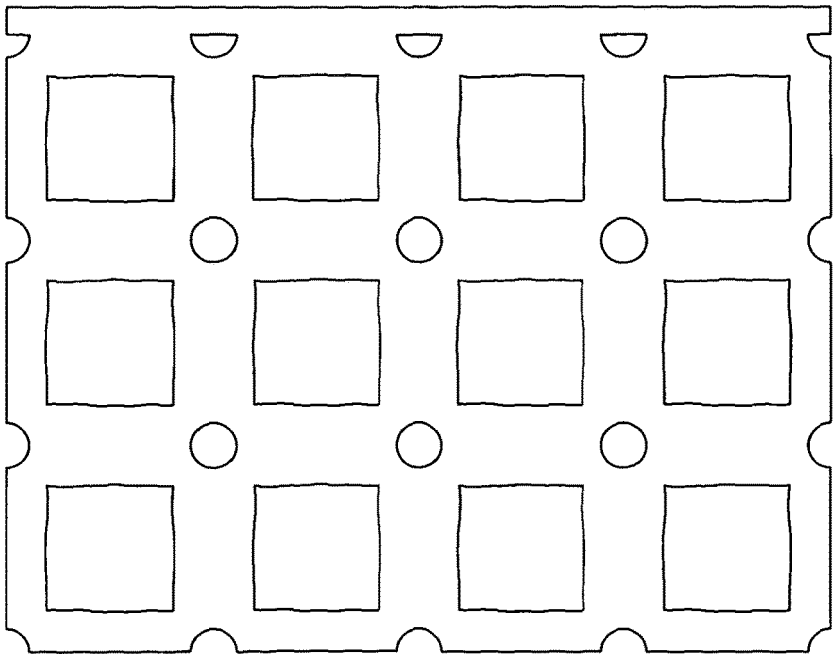
Figure 11B:
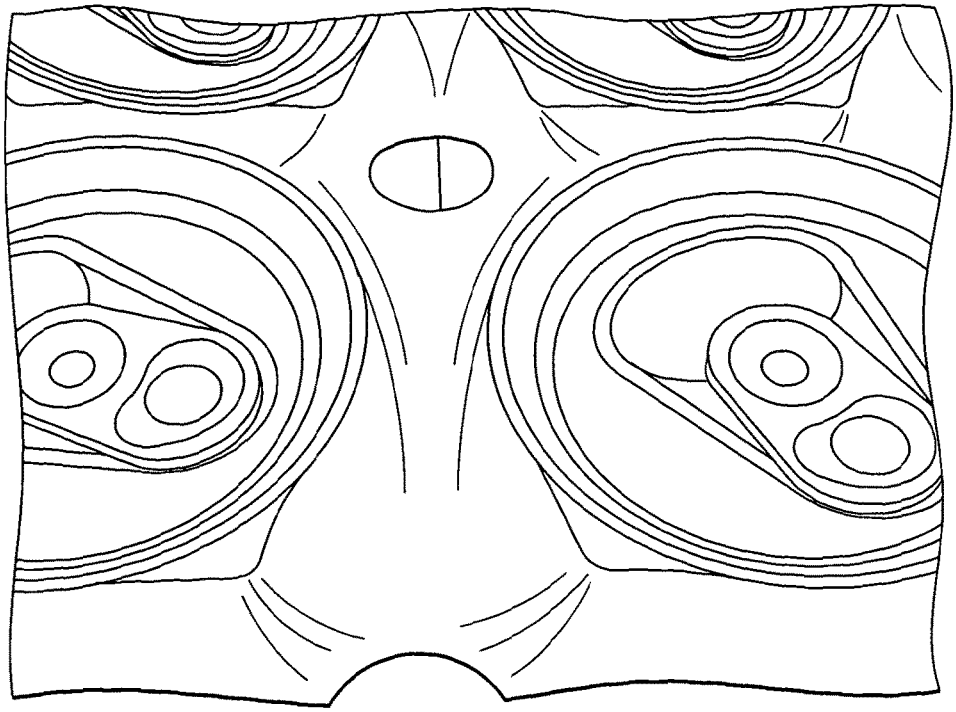
Figure 11C:
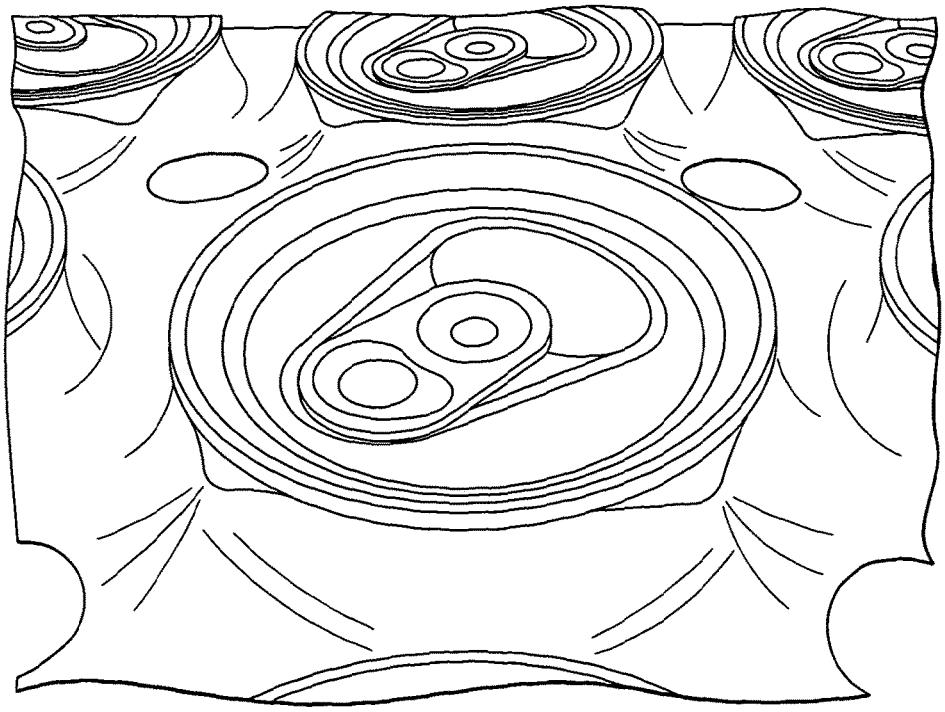
Figure 11D:
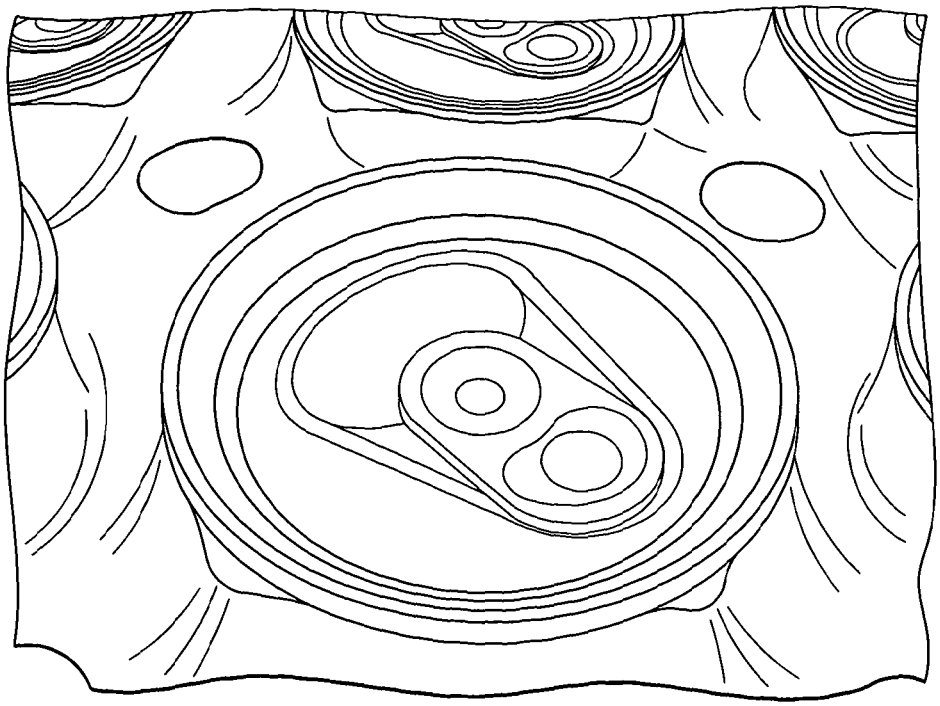

FIG. 10 shows a further portion of film 100, which has generally square apertures 101, which have fingers 102-105 separated by small troughs 106-109. The troughs are more pronounced with respect to the troughs of FIGS. 9 and 11, but may be of other shapes with regard to a requirement not to induce tears in the film. Again the distance between opposite troughs is approximately 110% the diameter of the container at the rim. FIG. 11 shows a still further embodiment, wherein each side of a generally square aperture comprises distinct arc sections 111-114; the troughs can be considered to exist at the centre of adjacent arcs 115-118. FIG. 11*a* shows a variant of the arcuate quadrilateral design wherein a substantially square aperture acts with tab elements having an inwardly facing arcuate tab. FIGS. 11*b*-11*d* show the variant of FIG. 11*a* in use.

A significant advantage of the present invention is that the mechanical properties of the material are only required to be strong enough to hold the cans, and not stand up to the rigours and high stretch of the standard application processes encountered in the prior art. Not only does this have significant advantages in the manufacturing processes (reduced operating forces incur less wear for application machines and thus further reduce operating costs), and also enables the use of cheaper plastics to be employed. Indeed, recycled plastics such as low grade Post Consumer Waste (e.g. low density polyethylene—LDPE) can be employed which also satisfies the perennial demands of market requirements in that the basic consumable materials are cheaper. As discussed above, in view of the materials not needing to be stretched to particular limits, the thickness of the basic product can also be reduced i.e. the thickness can be 300 μm (or less): the issue of the presence of inclusions or not is of no consequence. A preferred thickness for such stock for prior systems in an unstressed condition has been in a range from approximately 16 mils (400 μm) to approximately 17.5 mils (445 μm). The present invention allows the use of raw material that can be purchased at far more favourable rates than specified high quality material.

A preferred method of application utilises a simple roll on application method as shall be disclosed in detail hereinafter; a simple machine can be utilised in manufacturing industry; since great stretching forces are not applied, lever arm and/or hydraulic operations can be minimised and the strength of the machine need not be great, as a direct result compared to systems which stretch plastics towards and beyond their elastic limits. The use of simpler and cheaper machines will also enable the systems to be operated by smaller manufacturing concerns and thereby increase markets.

Figure 12:
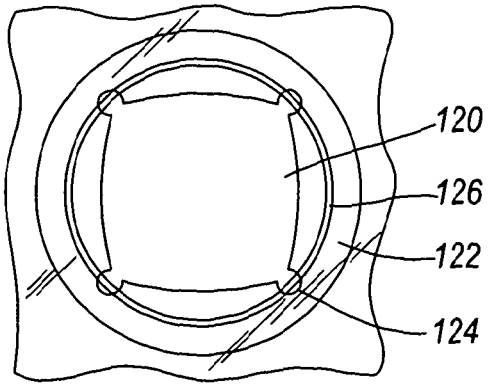
FIGS. 12-12*f* detail steps in the application process.
Figure 12A:
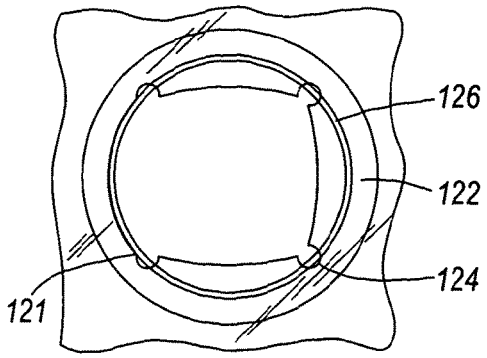
Figure 12B:
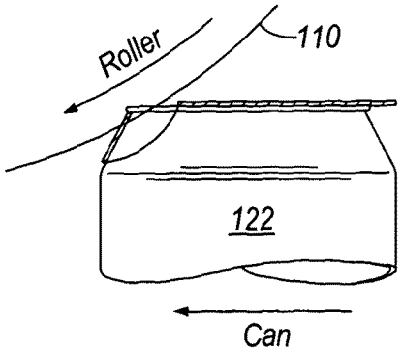

FIGS. 12*a*-12*f* show a superposition of the edges of an un-stretched aperture upon a beading 126 of a container 122. FIG. 12*a* shows how, in a first application step associated with retaining a number of containers with a stock of apertured plastics sheeting in accordance with the present invention. An inside tab edge 121 of the aperture abuts against an underside edge of a bead 126 of the container. FIG. 12*b* shows how, in relation to the apertured plastics sheet stock 100 an application roller will rotate with respect to a container passing underneath in a direction perpendicular to the roller axis. The roller is not shown, although the stock is shown having an arcuate profile and will be discussed in greater detail with respect to machinery below.

Figure 12C:
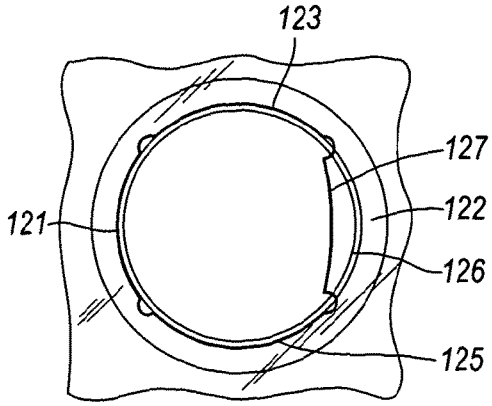
Figure 12D:
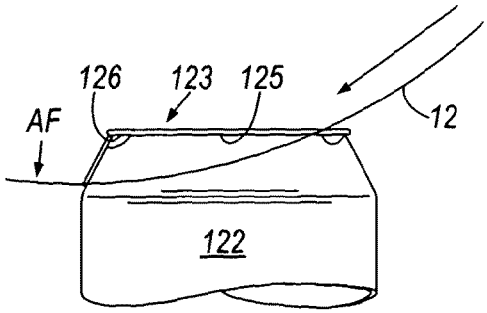

As the roller continues to move, with reference to FIGS. 12*c* & 12*d* the side edges 123 & 125 of the aperture diverge elastically to surround the sides of the container beading 126. It will be appreciated that this figure is part cross-section in the plane of the beading 126 and part side-perspective view of the can 122. The application forces AF, acting from a centre of the application roller, are relatively gentle—no forces which stretch the plastics sheet material beyond its elastic limit are present.

Figure 12E:
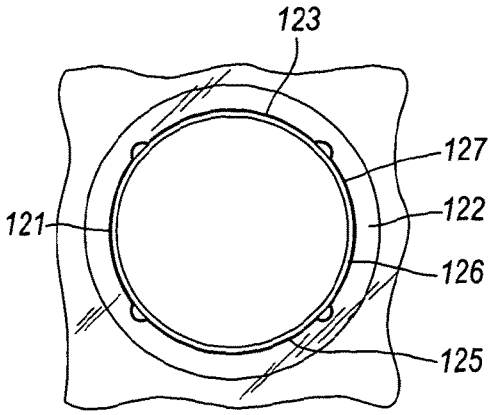
Figure 12F:
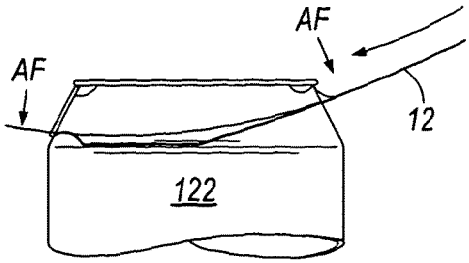

FIGS. 12*e* and 12*f* show corresponding plan and side view of the application process as the edge 127 is received by the rim of the container 126—as shown, the application roller is shown as the container passes below the axis of the roller As discussed above, in view of the reduced forces necessary to assemble containers, system power requirements would be reduced and energy consumption would be reduced. For example, by having the system applying film to containers in 6-12 rank widths, then packing stations can be made more compact and simplify distribution since larger widths of format negate a need to divert packs after application ready for tray packing process. A still further advantage in having a wider operating width is that the overall velocity of machinery can be reduced. Compared to a 2-rank packing system, the operating speed is one third to one sixth the speed of such 2-rank packing systems. This will have concomitant advantages in the lifetime, reliability (downtimes are expensive) and cost in the conveyor, the motors and supporting equipment. Equally the demands on material would be reduced, also permitting the use of lower grade material.

Figure 13A:
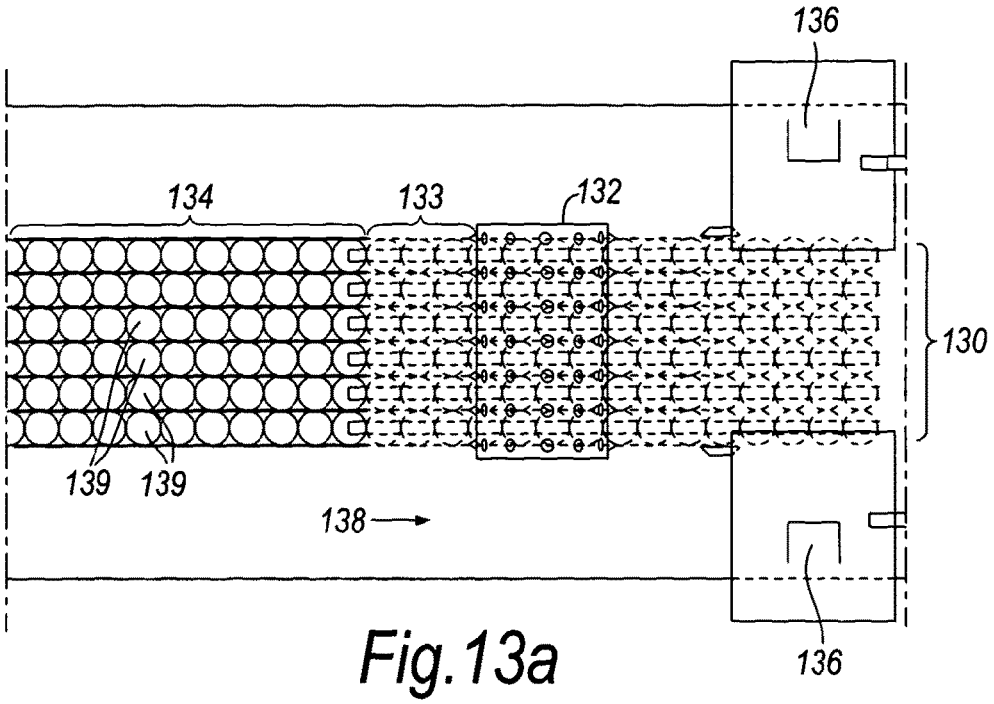
FIGS. 13*a* & *b* show manufacturing equipment in plan and side views.
Figure 13B:
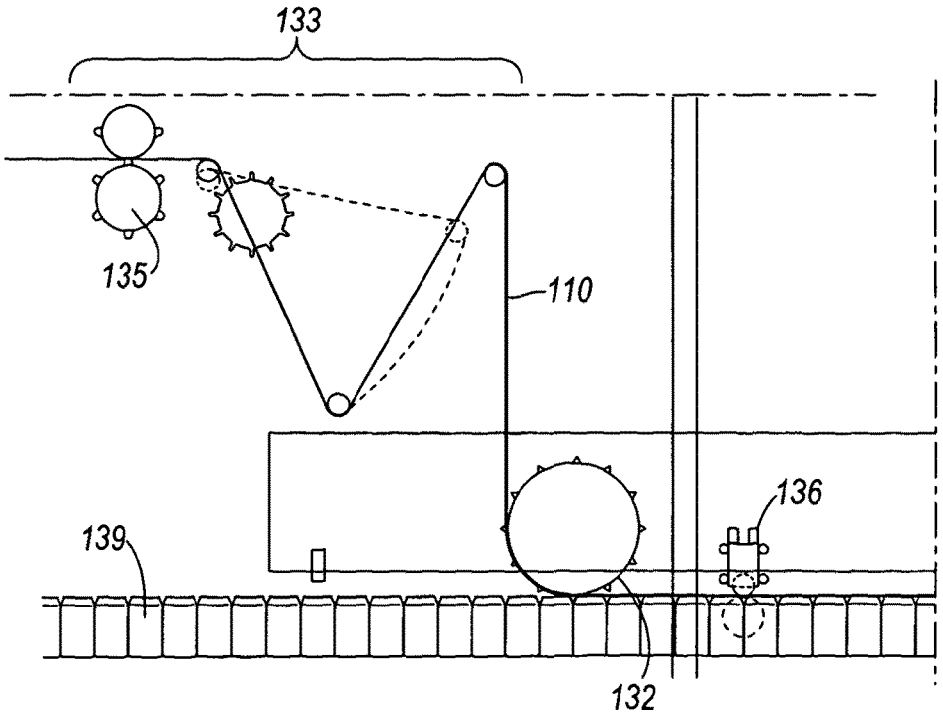

With reference to FIGS. 13*a* & 13*b*, there are shown plan and side views of an otherwise standard conveyor system 130 for the transport of containers in the form of soft-drinks cans 139 or similar. In particular, with reference to FIG. 13*a*, the cans 139 are fed along a conveyor to an accumulation position 134 (proceeding in a direction indicated by arrow 138). In the accumulation position, the containers are brought towards each other in close proximity in preparation for the application of the apertured retaining sheet, performed by roller 132 which receive sheet 110 from sheeting supply system 133. Cutting apparatus controlled between the units labelled 136 enable appropriate pack sizes to be produced. With reference to FIG. 13*b*, sheeting supply mandrel 135 can co-operate with another mandrel (not shown) to provide a continuous supply of sheeting to the roller 132. As is known, seamless connection of separate sheets can be performed to provide effective continuous operation, or at least almost continuous operation of the system.

Figure 14:
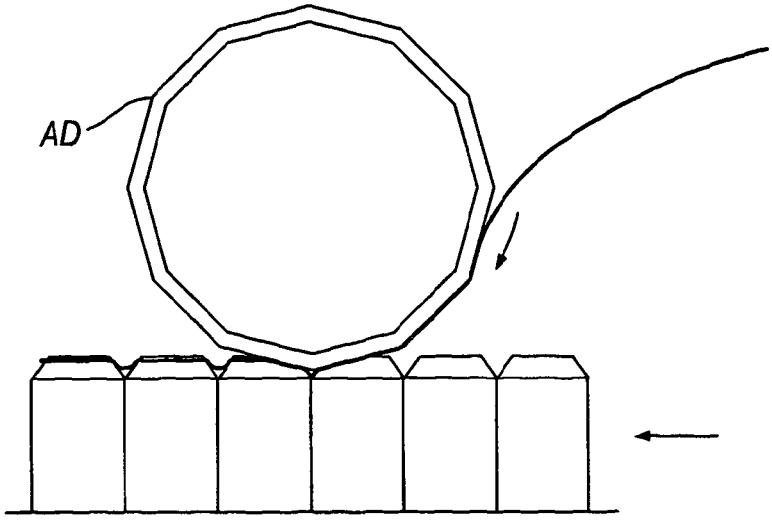
FIGS. 14-15 show views of a application drum in accordance with another aspect of the invention; and, FIGS. 16-21 show cans unitized with a further example of the invention.
Figure 15:
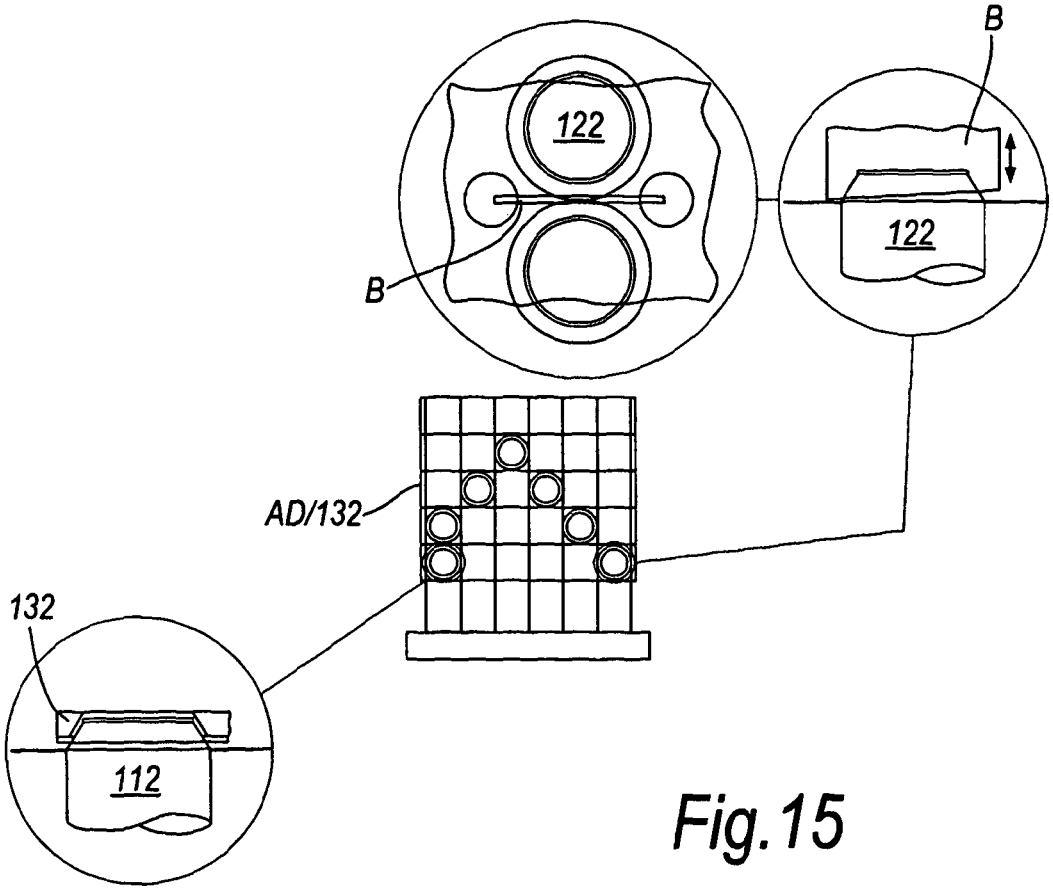
Figure 16:
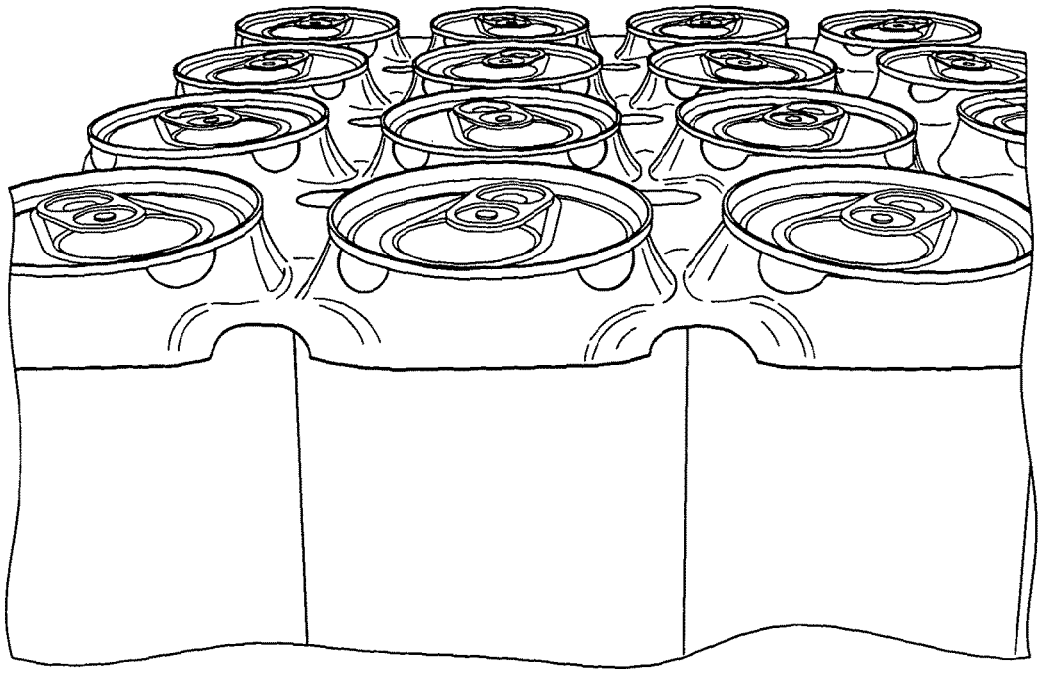
Figure 17:
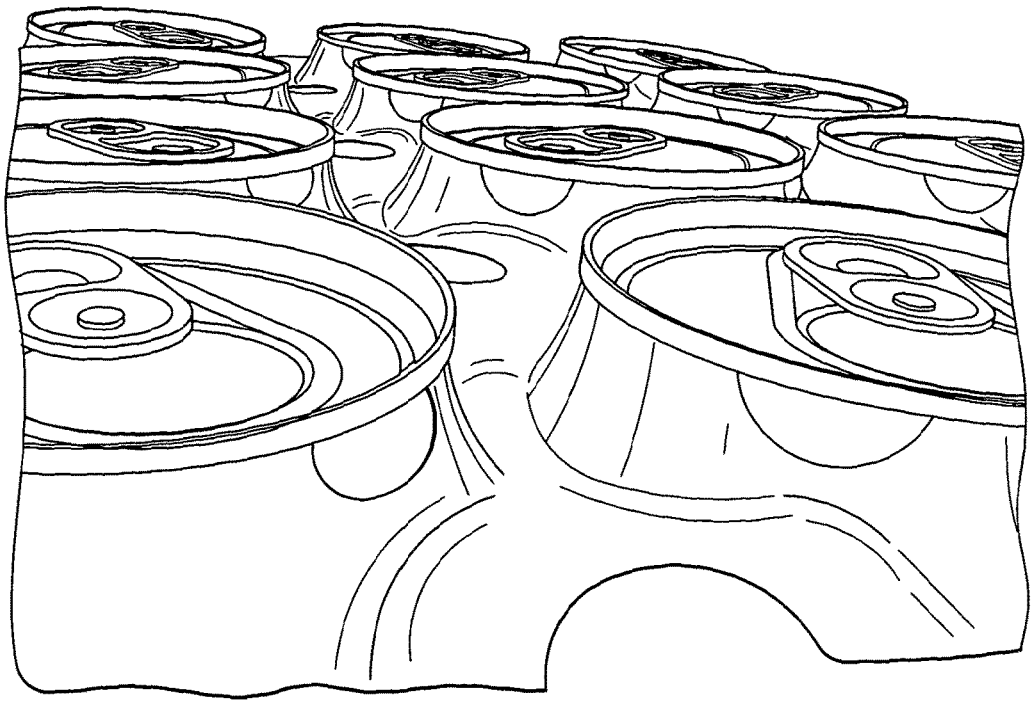
Figure 18:
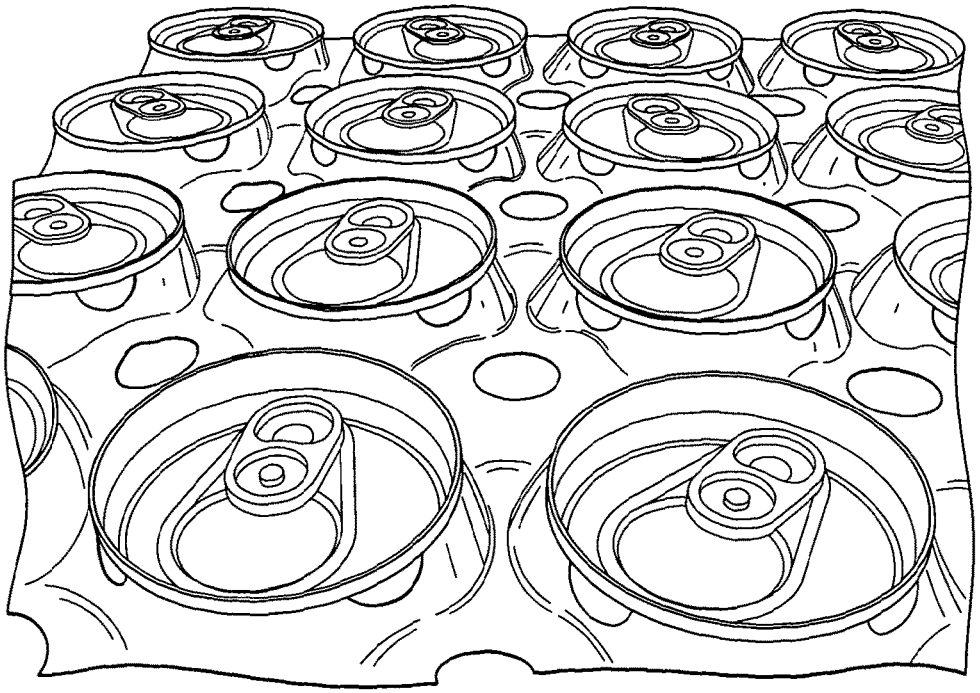
Figure 19:
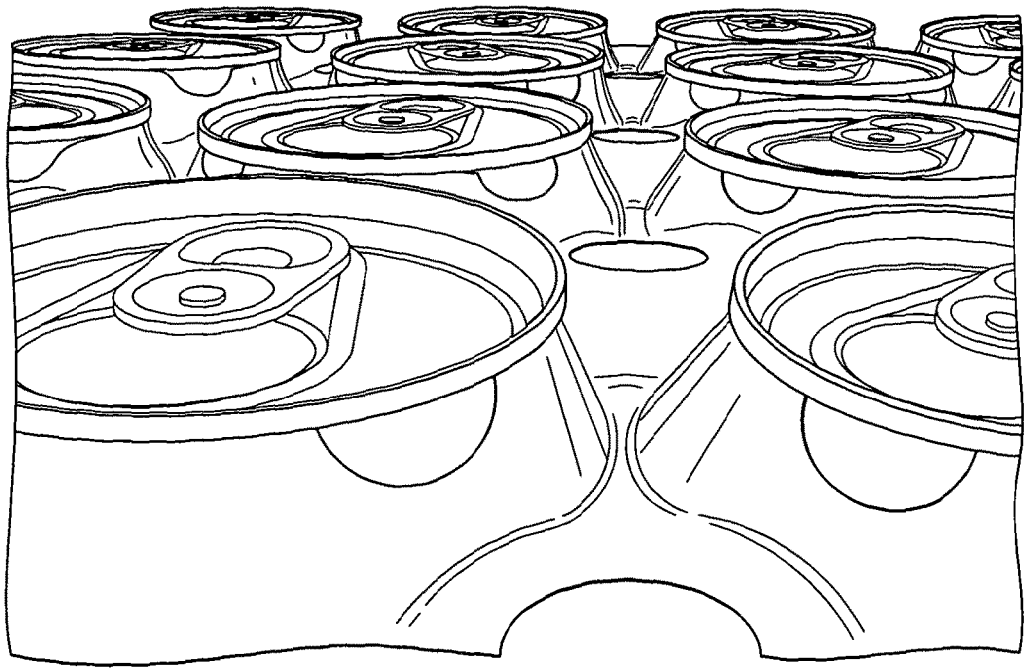
Figure 20:
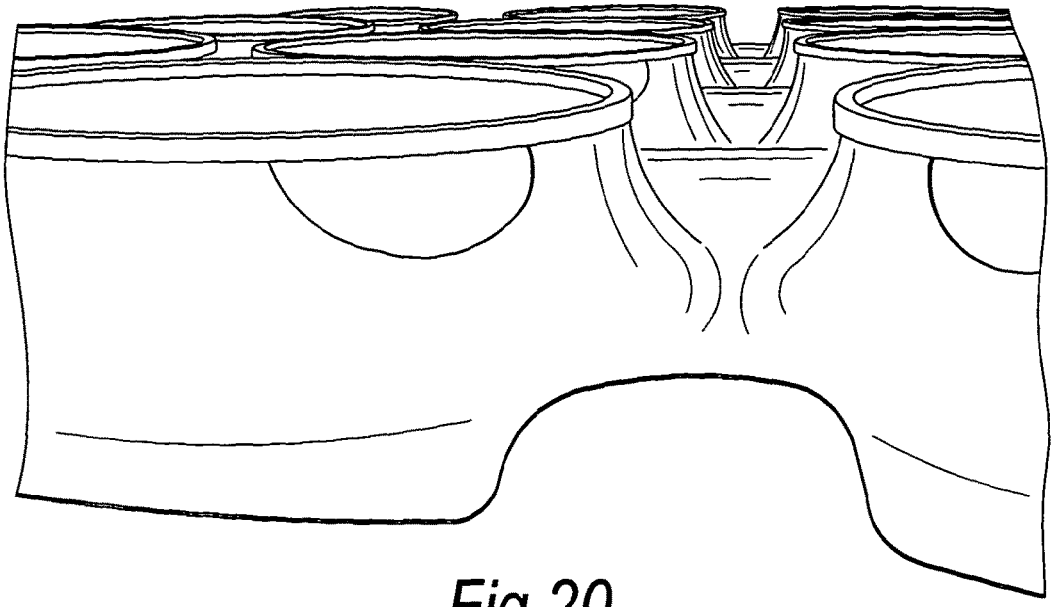
Figure 21:
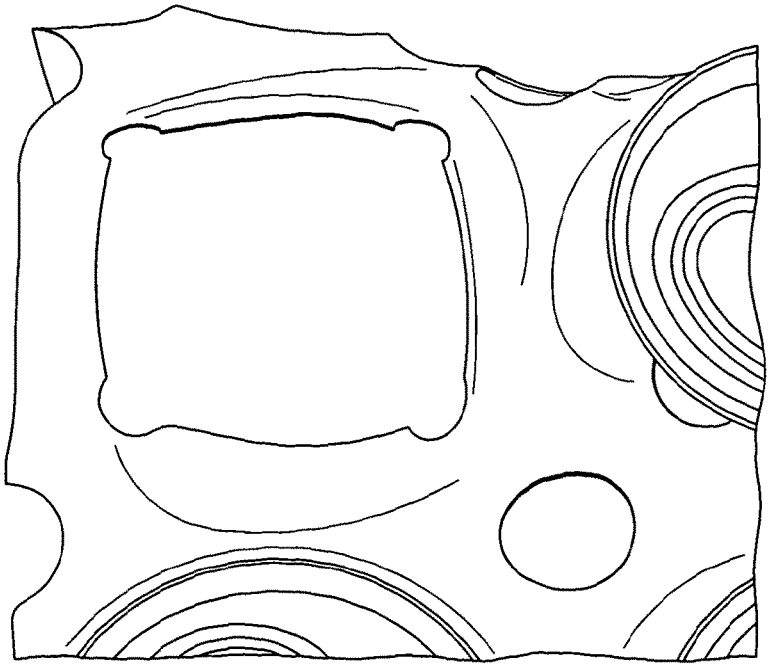

FIGS. 14 and 16 show, respectively side and detail view of the application drum and production line conveyor arrangement. FIGS. 17-21 show cans unitized with a further example of a carrier stock in accordance with the invention.

It will be appreciated that, since the containers can be arranged in 6+ wide lines, then different lines may be packaged differently using known techniques, adding variability to the production line process. Additionally, it would be possible, with appropriate channelling, to have cross over with other products (brands) whereby a perceived need for other machines/systems is not necessary. The carrier stock is formed, for example by die-cutting, from a single sheet of resilient polymeric material, such as low density polyethylene. Known carrier stock has been formed of high quality plastics sheet, such as low density polyethylene.

The invention claimed is:

1. A plastics film comprising a thin plastics sheet material, the thin plastics sheet material comprising:

a plurality of quadra-arcuate apertures for holding a plurality of containers together, each container of the plurality of containers having a beading, the plurality of quadra-arcuate apertures extending in at least a first direction of the plastics film;

wherein each quadra-arcuate aperture of the plurality of quadra-arcuate apertures has a center and wherein edges defining each quadra-arcuate aperture has a geometry which comprises four tabs facing the center, each tab of the four tabs being defined by peaks spaced apart by troughs, each trough defining a root at a maximum point from the center;

wherein the peaks and the roots lie, respectively, on first and second circumferences relative to the center, the second circumference, when the plastics film is in unstretched form and prior to placement about a container, being equal to or greater than a beading circumference of the container;

wherein each tab of the four tabs is curved such that each tab has a curved edge facing the center, each curved edge forming an arc of a circle, the circle having a radius that is greater than a distance between the curved edge and the center of each quadra-arcuate aperture of the plurality of quadra-arcuate apertures;

wherein a configuration of each quadra-arcuate aperture of the plurality of quadra-arcuate apertures is such that, upon placement of each quadra-arcuate aperture about a container of the plurality of containers, each peak of each tab engages with said beading of the container, wherein the plastics film, at a point where the peaks of the tabs meet with an underside of the beading of the container of the plurality of containers, is deflected in a downwards direction to form a non-planar wave effect in at least the first direction of the plastics film as the thin plastics sheet material elastically forms a three dimensional structure to retain the plurality of containers together; and wherein the plastics film can be provided as a roll.

2. The plastics film according to claim 1, wherein each tab extends inwardly towards the center.

3. The plastics film according to claim 1, wherein the troughs comprise rectilinear corner sections.

4. The plastics film according to claim 1, wherein the plastics film is made from a material comprising at least one of polyethylene, polyethylene derivatives and plastics materials with similar mechanical properties.

5. The plastics film according to claim 1, wherein the plastics film is made from recycled plastics.

6. The plastics film according to claim 5, wherein the plastics film is made from post consumer waste (PCW) plastics.

7. The plastics film according to claim 1, wherein the plastics film is made from 100-350 μm thickness plastics sheet.

8. The plastics film according to claim 1, further comprising further apertures within the thin plastics sheet material between the plurality of quadra-arcuate apertures for holding containers, such further apertures enabling stress relief, whereby each quadra-arcuate aperture of the plurality of quadra-arcuate apertures may more simply be fastened about a container.

9. The plastics film according to claim 1, wherein each quadra-arcuate aperture of the plurality of quadra-arcuate apertures is dimensioned to fit around cylindrical walled cans.

10. The plastics film according to claim 1, wherein each quadra-arcuate aperture of the plurality of quadra-arcuate apertures is dimensioned to fit about reduced chime or necked cans.

11. The plastics film according to claim 1, wherein each quadra-arcuate aperture of the plurality of quadra-arcuate apertures is dimensioned to fit around a neck of a bottle.

12. The plastics film according to claim 1, wherein the plurality of quadra-arcuate apertures are arranged in a single row.

13. The plastics film according to claim 1, wherein the plurality of quadra-arcuate apertures are arranged in more than one row.

14. The plastics film according to claim 1, wherein the beading of the container is a chime of a beverage container.

15. The plastics film according to claim 1, wherein the plurality of quadra-arcuate apertures can be placed over the beading circumference by deflecting the tabs and without stretching the plurality of quadra-arcuate apertures.

16. A method of unitizing containers utilizing the plastics film of claim 1, the method comprising:

receiving a container of the plurality of containers;

urging the curved edge of a tab of one quadra-arcuate aperture of the plurality of quadra arcuate apertures toward an under-chime edge of the container;

easing adjacent side tabs of the one quadra-arcuate aperture over a corresponding rim of the container until the curved edge of the one quadra-arcuate aperture opposite a first engaged side of the one quadra-arcuate aperture is adjacent the corresponding rim of the container; and causing the curved edge of a last tab to engage with an underside of the rim of the container, whereby to secure the plastics film with the container.

* * * * *